US005154573A

United States Patent [19]

Buse

[11] Patent Number: 5,154,573

[45] Date of Patent: Oct. 13, 1992

[54] COOLING SYSTEM FOR CENTRIFUGAL PUMP COMPONENTS

[75] Inventor: Frederic W. Buse, Allentown, Pa.

[73] Assignee: Ingersoll-Rand Company, Woodcliff Lake, N.J.

[21] Appl. No.: 758,579

[22] Filed: Sep. 12, 1991

[51] Int. Cl.[5] ..... F01D 11/04; F01D 25/18

[52] U.S. Cl. ..... 415/110; 415/175; 415/177; 417/369

[58] Field of Search ..... 415/170.1, 175, 176, 415/177, 178, 180, 182.1, 110, 111; 417/366, 369, 370

[56] References Cited

U.S. PATENT DOCUMENTS

| | | | |
|---|---|---|---|
| 1,880,747 | 10/1927 | Bowen | 415/175 |
| 2,531,997 | 11/1950 | Wade | 415/182.1 |
| 3,816,020 | 6/1974 | Ogles | 415/111 |
| 4,380,416 | 4/1983 | Menager | 415/168.2 |
| 4,591,311 | 5/1986 | Matsuda et al. | 417/366 |

*Primary Examiner*—Thomas E. Denion
*Assistant Examiner*—Mark Sgantzos
*Attorney, Agent, or Firm*—Michael H. Minns

[57] ABSTRACT

A cooling system for centrifugal pump bearings and seals for use with a centrifugal pump having a housing containing a pumping chamber and a rotating impeller within the pumping chamber, a passage being formed in the housing, the passage receiving fluid from the pumping chamber and directing the fluid thereby providing cooling fluid flow, and an arcuate groove formed in the housing in fluid communication with the passage, a first end of the groove being adjacent the passage, a second end of the groove being distal of said passage, the groove having a depth which varies from the first end to the second end, the depth at the first end being greater than the depth at the second end.

5 Claims, 2 Drawing Sheets

COOLING SYSTEM FOR CENTRIFUGAL PUMP COMPONENTS

BACKGROUND OF THE INVENTION

This invention relates generally to cooling systems for mechanical seals for centrifugal pumps and to cooling systems for magnetic bearings for sealless centrifugal pumps. This invention more particularly relates to the use of a drilled passage in the pump casing to direct cooling flow to selected pump components.

A sealless pump is the type of centrifugal pump that has its impeller and bearing system isolated from the impeller driving mechanism by an isolating wall that seals the pumping mechanism from the surrounding environment and eliminates the necessity to use rotary seals to seal the pumped fluid against leaking along the shaft. U.S. Pat. No. 4,871,301, Centrifugal Pump Bearing Arrangement, illustrates a sealless pump.

Manufacturers of sealless pumps and users of mechanical seals take liquid from behind the impeller via drilled passages in the casing cover or stuffing box to the shell area or mechanical seal chamber. The drilled passage is a hole in the wall of the casing cover or stuffing box. The actual pressure obtained in the drilled passage is much less than the calculated pressure. Tests show that for a particular size pump, the relative pressure of the liquid in the shell area is only 64% of the total head.

The higher the relative pressure in the shell or seal chamber, the more efficient the cooling of the magnetic bearings or the mechanical seals. Tests have also shown that the greater the bolt circle diameter that the drilled passage is located in, the greater the pressure loss in the drilled passage.

The foregoing illustrates limitations know to exist in present cooling systems for mechanical seals or magnetic bearings. Thus, it would be apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a cooling system for centrifugal pump bearings and seals, the centrifugal pump having a housing containing a pumping chamber and a rotating impeller within the pumping chamber, the cooling system comprising a passage formed in the housing, the passage receiving fluid from the pumping chamber and directing the fluid thereby providing cooling fluid flow and an arcuate groove formed in the housing in fluid communication with the passage, a first end of the groove being adjacent the passage, a second end of the groove being distal of said passage, the groove having a depth which varies from the first end to the second end, the depth at the first end being greater than the depth at the second end.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 1:
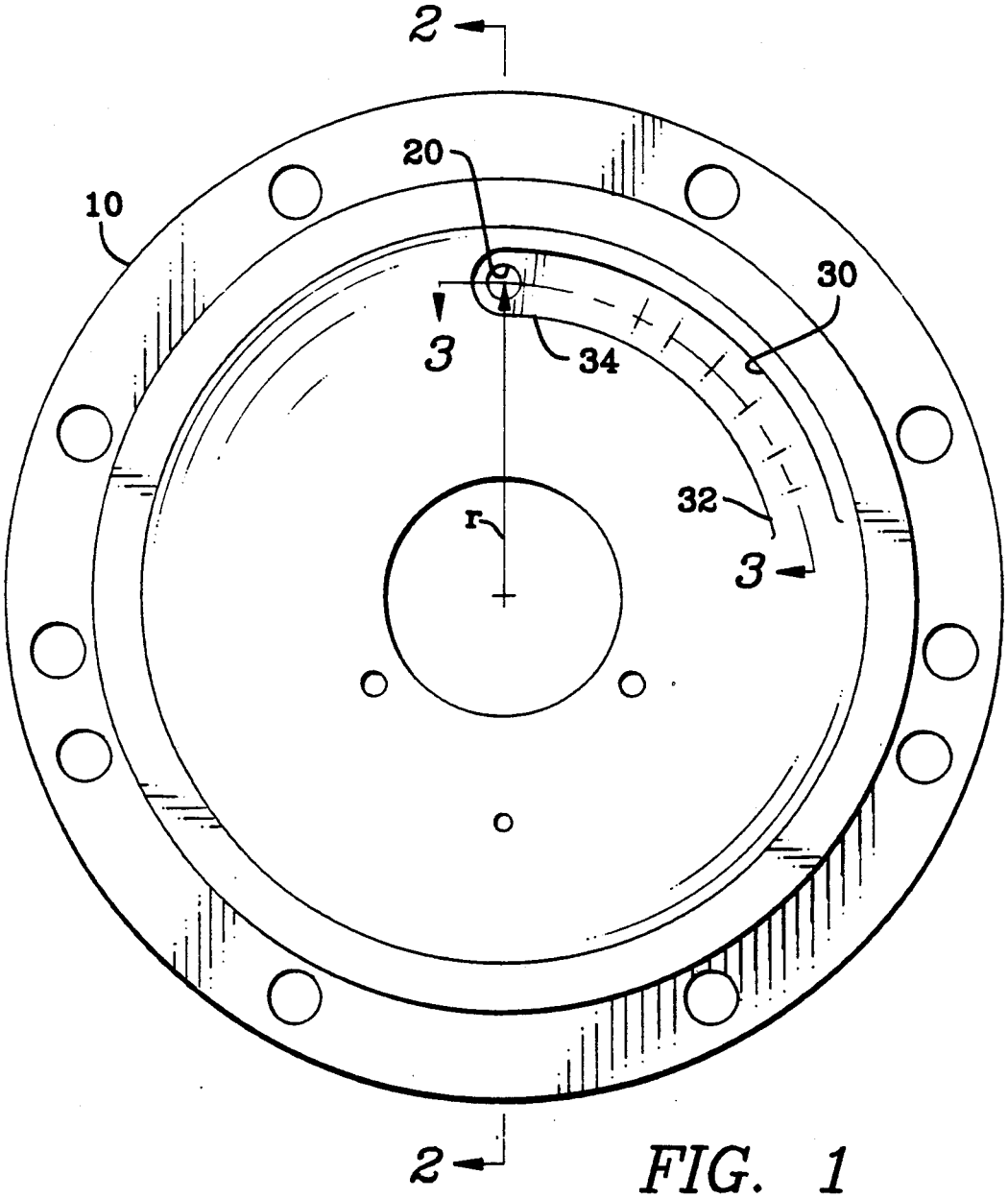
FIG. 1 is a front view of a centrifugal pump casing cover illustrating an embodiment of the cooling system for centrifugal pump components.
Figure 2:
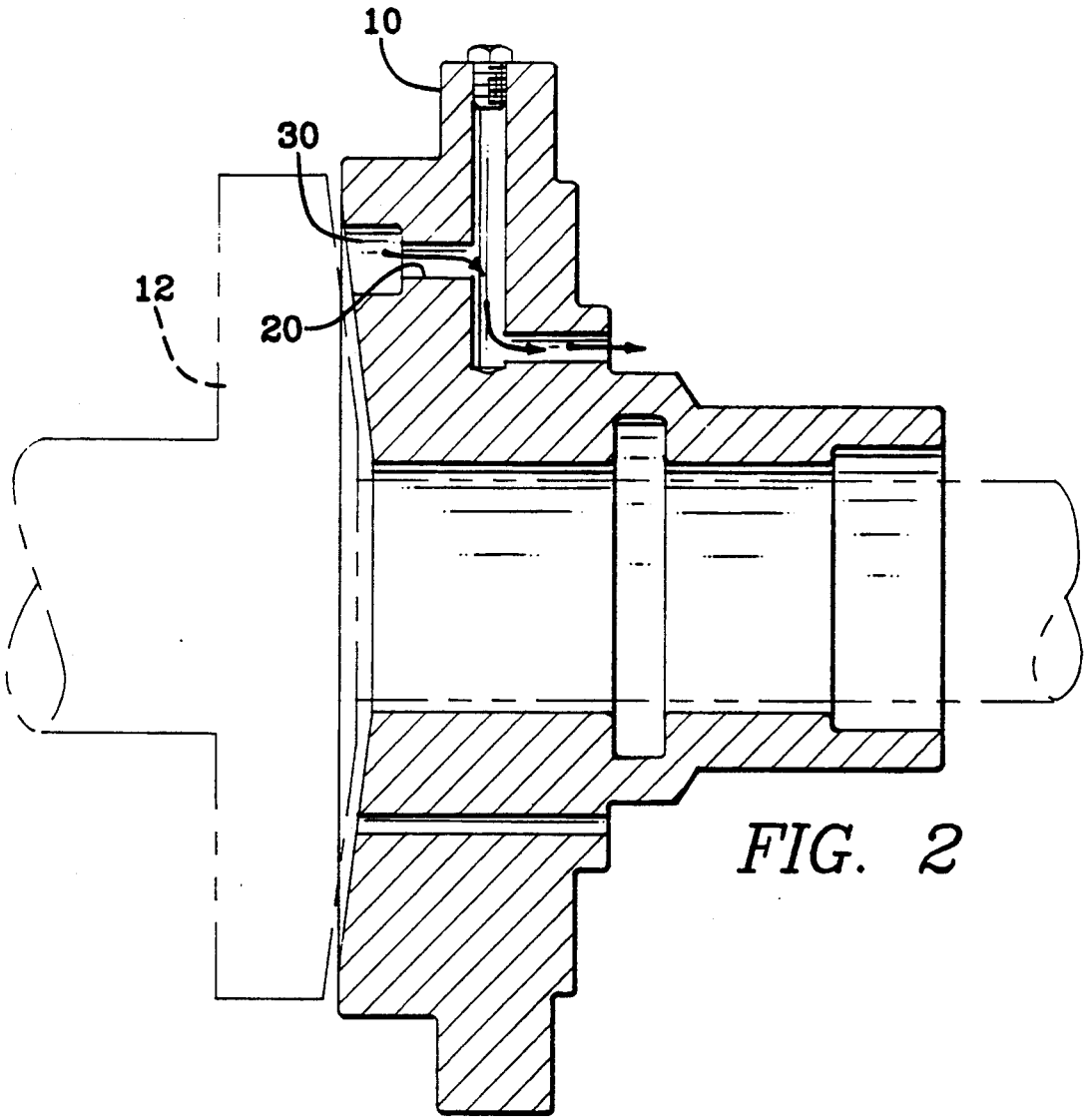
FIG. 2 is a cross-section of the pump casing cover of FIG. 1 showing an impeller in relation to the pump casing cover.

FIGS. 1 and 2 show a pump casing cover 10 in relation to a pump impeller 12. A cooling passage 20 is drilled in the pump casing cover 10 to direct a small portion of the pumped fluid through the pump casing cover 10 and to pump components (not shown) such as mechanical seals or magnetic bearings. The pump impeller rotates and imparts motion to a fluid, the fluid moving from an upstream point to a downstream point.

Figure 3:
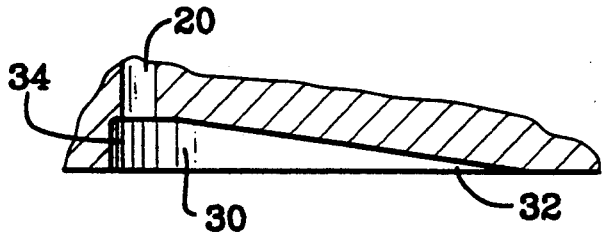
FIG. 3 is a cross-section of a detail of FIG. 1.

An arcuate groove 30 is formed in the inside surface of the pump casing cover 10. One end 34 of the groove 30 is coincident with the cooling passage 20. The other end 32 of the groove 30 extends upstream of the cooling passage 20. The depth of the groove 30 increases from the upstream end 32 to the cooling passage end 34 as shown in FIG. 3. In the preferred embodiment, the curve of the arcuate groove 30 matches the curve of a circle having a radius r the same as the distance the cooling passage 20 is from the center of the pump casing cover 10. The length of the groove 30 is between 60° and 90°.

For a groove 30 depth at the cooling passage 20 of 0.375 inch to 0.44 inch and a groove 30 width 0.125 inch greater than the cooling passage 20 diameter, a shell pressure or mechanical seal chamber of 73% of the total head was obtained. This is compared to a shell pressure of 64% for the same diameter cooling passage 20 without the groove 30.

Having described the invention, what is claimed is:

1. A cooling system for centrifugal pump bearings and seals, the cooling system for use with a centrifugal pump having a housing containing a pumping chamber and a rotating impeller within the pumping chamber, the cooling system comprising:

passage means formed in the housing for receiving fluid from the pumping chamber and directing the fluid thereby providing cooling fluid flow; and an arcuate groove formed in the housing in fluid communication with the passage means, a first end of the arcuate groove being adjacent the passage means, a second end of the arcuate groove being distal of said passage means, the arcuate groove having a depth which varies from the first end to the second end, the depth at the first end being greater than the depth at the second end.

2. The cooling system of claim 1 wherein the rotating impeller imparts motion to a fluid, the fluid moving from an upstream point to a downstream point, the second end of the arcuate groove being upstream of the first end.

3. A cooling system for centrifugal pump bearings and seals, the cooling system for use with a centrifugal pump having a housing containing a pumping chamber and a rotating impeller within the pumping chamber, the rotating impeller imparting motion to a fluid, the fluid moving from an upstream point to a downstream point, the cooling system comprising:

passage means formed in the housing for receiving fluid from the pumping chamber and directing the fluid thereby providing cooling fluid flow; and an arcuate groove formed in the housing in fluid communication with the passage means, a first end of the arcuate groove being coincident with the passage means, a second end of the arcuate groove being upstream of said passage means, the arcuate groove having a depth which varies from the first end to the second end, the depth at the first end being greater than the depth at the second end.

4. The cooling system of claim 3 wherein the arcuate groove is located on a curved line, the curved line having a constant radius.

5. The cooling system of claim 3 wherein the arcuate groove has a length between 60 degrees and 90 degrees of a full circle.

* * * * *